US006870448B2

(12) United States Patent
Whitener et al.

(10) Patent No.: US 6,870,448 B2
(45) Date of Patent: Mar. 22, 2005

(54) ADJUSTABLE COAXIAL SUPPORT

(75) Inventors: Michael B. Whitener, Santa Rosa, CA (US); Michael T. Powers, Santa Rosa, CA (US); Matthew R. Richter, Santa Rosa, CA (US); Donald J. Taylor, Healdsburg, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 60 days.

(21) Appl. No.: 10/388,792

(22) Filed: Mar. 14, 2003

(65) Prior Publication Data

US 2004/0178868 A1 Sep. 16, 2004

(51) Int. Cl.[7] ..... H01P 3/06

(52) U.S. Cl. ..... 333/244; 333/256; 333/27

(58) Field of Search ..... 333/244–246, 333/80, 27, 254, 256, 257, 260, 33; 439/578, 633, 638

(56) References Cited

U.S. PATENT DOCUMENTS

| | | | | | |
|---|---|---|---|---|---|
| 3,936,125 | A | | 2/1976 | Hutter | |
| 3,936,132 | A | | 2/1976 | Hutter | |
| 3,993,966 | A | | 11/1976 | Reindel | |
| 3,994,553 | A | | 11/1976 | Kornick | |
| 4,035,054 | A | | 7/1977 | Lattanzi | |
| 4,186,358 | A | | 1/1980 | Czech et al. | |
| 4,231,003 | A | | 10/1980 | Ishimaru | |
| 4,296,986 | A | | 10/1981 | Herrmann, Jr. | |
| 4,360,245 | A | | 11/1982 | Nikitas | |
| 4,365,195 | A | * | 12/1982 | Stegens | 324/754 |
| 4,368,940 | A | | 1/1983 | Sugiura | |
| 4,662,703 | A | | 5/1987 | Forney, Jr. et al. | |
| 4,669,805 | A | | 6/1987 | Kosugi et al. | |
| 4,690,482 | A | | 9/1987 | Chamberland et al. | |
| 4,724,409 | A | * | 2/1988 | Lehman | 333/260 |
| 4,824,399 | A | | 4/1989 | Bogar et al. | |
| 4,855,697 | A | * | 8/1989 | Jones et al. | 333/33 |
| 4,917,631 | A | | 4/1990 | Souders et al. | |
| 4,936,800 | A | | 6/1990 | Couper et al. | |
| 4,971,578 | A | | 11/1990 | Wilson | |
| 5,017,865 | A | * | 5/1991 | Oldfield | 324/754 |
| 5,049,843 | A | | 9/1991 | Barnes et al. | |
| 5,067,912 | A | | 11/1991 | Bickford et al. | |
| 5,075,630 | A | * | 12/1991 | Babbitt et al. | 324/629 |
| 5,138,436 | A | * | 8/1992 | Koepf | 257/728 |
| 5,142,253 | A | * | 8/1992 | Mallavarpu et al. | 333/127 |
| 5,280,253 | A | * | 1/1994 | Deki et al. | 333/26 |
| 5,298,683 | A | | 3/1994 | Taylor | |
| 5,402,088 | A | * | 3/1995 | Pierro et al. | 333/33 |
| 5,432,487 | A | * | 7/1995 | Dydyk | 333/161 |
| 5,576,675 | A | | 11/1996 | Oldfield | |
| 5,994,977 | A | * | 11/1999 | Taya | 333/111 |
| 6,320,477 | B1 | | 11/2001 | Lithgow et al. | |
| 6,377,464 | B1 | * | 4/2002 | Hashemi et al. | 361/760 |
| 6,414,563 | B1 | | 7/2002 | Tsironis | |
| 6,575,785 | B2 | * | 6/2003 | Bohmer et al. | 439/578 |

* cited by examiner

*Primary Examiner*—Timothy P. Callahan
*Assistant Examiner*—Hai L. Nguyen

(57) ABSTRACT

A movable support for a coaxial structure, such as a coaxial feed-through, connector, or cable, allows adjusting the height of a center pin of the coaxial structure relative to the surface of a high-frequency planar microcircuit mounted on a base. The height of the center pin is optimized to provide a high-frequency transition between the coaxial transmission structure and a planar transmission structure, such as a stripline structure, on the planar microcircuit. An interference fit between the movable support and base at the operating height provides a high-quality ground contact underneath the center pin.

20 Claims, 4 Drawing Sheets

ADJUSTABLE COAXIAL SUPPORT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a device for connecting a high-frequency planar microcircuit to a coaxial transmission structure, and more specifically an adjustable support that allows adjusting the height of a center pin of the coaxial transmission structure relative to the surface of the high-frequency planar microcircuit.

BACKGROUND OF THE INVENTION

Planar microcircuits are often used in high-frequency applications. A planar microcircuit is typically fabricated on an alumina substrate, sapphire substrate, or semiconductor wafer using thin-film or thick-film techniques. Planar microcircuits are also fabricated on circuit boards. One or more planar microcircuits are mounted in a package to form a microcircuit module, also commonly referred to as a packaged microcircuit.

Planar microcircuits use planar transmission structures, such as microstrip or coplanar waveguide ("CPW"), and high-frequency signals are typically routed between microcircuit modules using semi-rigid coaxial cables. Planar microcircuits are typically packaged in metal, cavity-type packages with coaxial connectors or feed-throughs that provide transitions from the planar transmission structures to the coaxial cables. A center pin of the coaxial feed-through extends into the interior of the packaged microcircuit over a planar transmission structure, and the center pin is subsequently electrically connected to the planar transmission structure using solder, conductive epoxy, or a ribbon or wire bond.

When the package is machined, a socket for the coaxial feed-through is positioned high enough to account for fabrication tolerances in the machining of the socket, variations in coaxial feed-through, thickness of the planar microcircuit, and thickness of solder or conductive epoxy used to attach the planar circuit to the package. The height of the coaxial feed-through, and hence the center pin, is fixed by the position of the socket and cannot be adjusted. Unfortunately, the height of the center pin of the coaxial feed-through might not be optimum for the electrical performance of the packaged microcircuit.

A package for a planar microcircuit can be quite complex, requiring significant design and fabrication time. Unfortunately, changes to the planar microcircuit might also require a change to the package, triggering another round of package design and fabrication, and often resulting in scrapping previously fabricated packages.

The complexity of the package can significantly increase if several planar microcircuits are incorporated into a single package. Such a package is not usually suitable for testing only one of the microcircuits. Waiting for all the microcircuits to be designed and fabricated before being able to test any of them can significantly slow the development time. Similarly, if all the microcircuits are tested in a single package, it might be difficult to isolate problems in a particular microcircuit.

BRIEF SUMMARY OF THE INVENTION

An adjustable coaxial support includes a sliding block coupled to a base. The sliding block has a socket for accepting a coaxial structure, such as a coaxial feed-through, coaxial connector, or coaxial cable. A center conductor of the coaxial structure extends through an aperture in the sliding block over a planar microcircuit mounted on the base. The height of the center conductor relative to the planar microcircuit is adjustable, and may be optimized to provide a high frequency transition between the coaxial structure and a planar transmission structure, such as a stripline structure, on the planar microcircuit. An interference fit between the sliding block and the base provides a high-quality ground plane contact underneath the center conductor when the sliding block is adjusted to the desired operating height.

DETAILED DESCRIPTION OF THE EMBODIMENTS

I. Introduction

The present invention provides an adjustable coaxial support that allows precise vertical adjustment of a coaxial transmission structure in relation to a planar microcircuit. The adjustable coaxial support includes a sliding block coupled to a base with a sliding joint. The planar microcircuit is mounted to the base, and a coaxial feed-through, coaxial cable, or other coaxial structure is supported by the sliding block. The sliding block is lowered toward the planar microcircuit to bring a center conductor of the coaxial structure to a desired height above or at the surface of the planar microcircuit.

II. Exemplary Adjustable Coaxial Supports

Figure 1A:
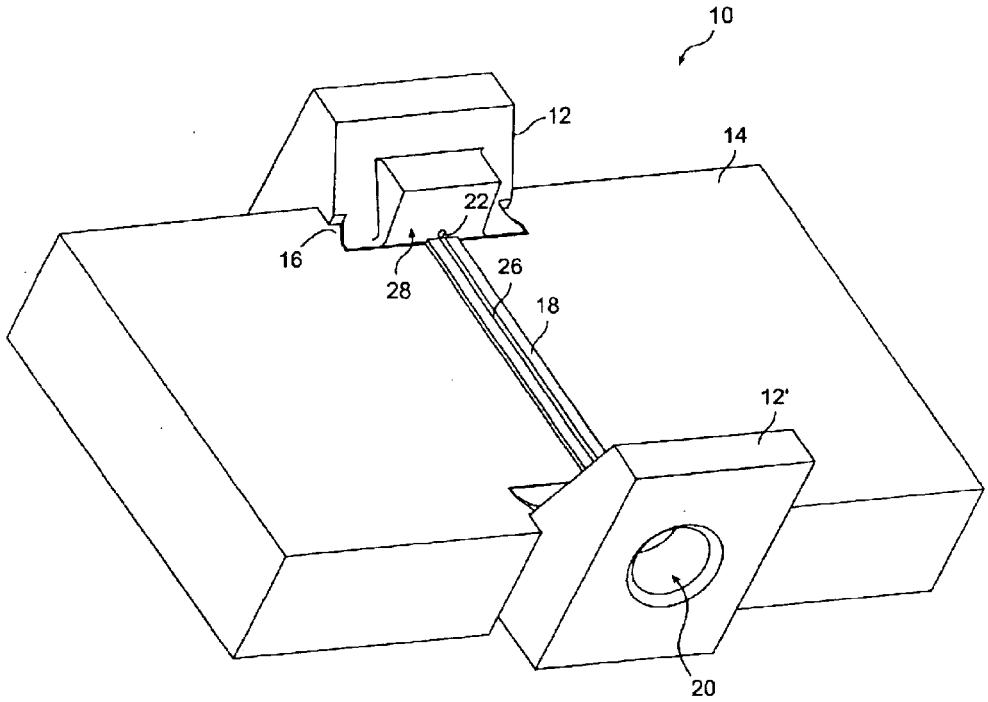
FIG. 1A is a perspective view of an adjustable coaxial support according to an embodiment of the present invention.

FIG. 1A is a perspective view of an adjustable coaxial support 10 according to an embodiment of the present invention. The adjustable coaxial support 10 includes a sliding block 12, a second sliding block 12', and a base 14. Alternative embodiments have a single sliding block or additional sliding blocks. The sliding block 12 is coupled to the base 14 with a dovetail joint 16. The dovetail joint 16 allows the sliding block 12 to move up and down (i.e. slide) relative to a planar microcircuit 18 mounted on the base 14 with conductive epoxy, solder, or eutectic (not shown). The second sliding block 12' is similarly coupled to the base 14 to allow vertical adjustment.

The second sliding block 12' includes a socket 20 for a coaxial transmission structure (not shown in this view), and the sliding block 12 has a similar socket. The socket 20 might be threaded to accept a screw-in coaxial feed-through or connector, or might be smooth to accept a press-in or soldered coaxial feed-through, connector, or cable. Coaxial transmission structures generally include a center pin or center conductor (not shown in this view) that extends through an aperture 22 over a conductor 26 of the planar microcircuit 18. If the planar microcircuit is a microstrip transmission structure, the side of the planar microcircuit opposite the conductor 26 is metallized to form a ground plane. The ground plane is electrically coupled to the base 14 with solder or other conductive material.

The base 14 and sliding block 12 are typically formed from metal, such as beryllium-copper alloy, tellurium-copper alloy, tungsten-copper alloy, mild steel, stainless steel, or aluminum by machining, casting, or broaching. It is generally desirable to match the thermal coefficient of linear expansion ("TCE") of the material selected for the base with the TCE of the substrate of the intended planar microcircuit. When using the base 14 with planar microcircuits that generate heat, it is generally desirable to choose a base material with a high thermal conductivity. Copper alloys provide high thermal conductivity, and can be chosen to provide a good TCE match by selection of the ratio of copper to the other alloy constituent(s), such as tungsten. In some embodiments, the base 14 and sliding block 12 are plated with materials, such as with soft gold, hard gold, palladium, platinum, or nickel. One type of plating might be used on the base 12 and another on the sliding block 12. "Soft" gold plating is generally pure (99.9%) gold deposited using an electroless plating method without cyanide, but could be any gold plating having a Knoop hardness less than about 90. "Hard" gold plating is generally a gold alloy that includes one or more hardening elements, such as nickel or cobalt, and is deposited in a cyanide-containing electrolytic plating bath or other plating bath.

In a particular embodiment the sliding block 12 was made of beryllium-copper alloy, the base was made of beryllium-copper alloy, and both parts were plated with soft gold. Beryllium copper provides resiliency to allow the dovetail joint 16 to deform slightly to hold the sliding block 12 in contact with the base 14 when the face of the sliding block interferes with the base. The soft gold was discovered to provide a superior ground connection between the sliding block 12 and base 14, and to more securely hold the sliding block 12 in relation to the base after adjusting the sliding block 12 to the desired height, particularly when both the base 14 and the sliding block 12 are plated with soft gold. An optional locking mechanism (see generally, FIG. 4) can be used to further secure the sliding block 12. The base 14 was about 5 mm (0.197 inches) thick, and the sliding block 12 was about 9.8 mm (0.386 inches) high, although these materials and dimensions are merely exemplary.

Figure 1B:
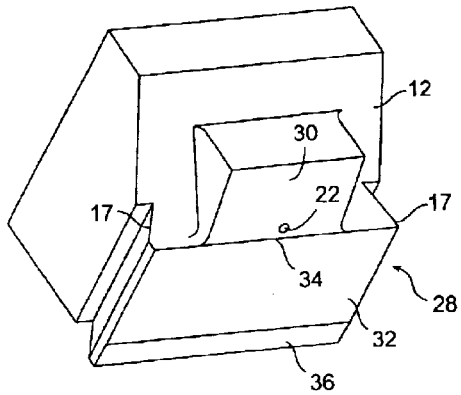
FIG. 1B is a perspective view of a sliding block of the adjustable coaxial support of FIG. 1A.

FIG. 1B is a perspective view of the sliding block 12 of the adjustable coaxial support of FIG. 1A. A face 28 of the sliding block 12 includes a vertical portion 30 separated from an angled portion 32 by a break line 34. The break line 34 is located a selected distance below the center of the aperture 22 according to the intended thickness of the planar microcircuit that will be used with the adjustable coaxial support and the type of coaxial structure. The angled portion 32 is tapered at an angle of about 0.15 degrees from the plane of the vertical portion 30. Alternatively, the tapered portion is omitted (i.e. the face is entirely vertical) or the angle of the tapered portion can be increased, but generally should not be increased to the point that the sliding block 12 will rock against the base 14 (see FIG. 1A). In an alternative embodiment, the base 14 is tapered instead of the sliding block 12. An optional lead-in portion 36 facilitates inserting the sliding block into the base 14. The lead-in portion 36 is at an angle of about five degrees from the vertical portion 30. A dovetail tenon 17 in the sliding block mates with a corresponding mortise in the base 14 (see generally FIG. 3). The dovetail tenon 17 and mortise are mating halves of the dovetail joint (see FIG. 1A, ref. num. 16).

Figure 1C:
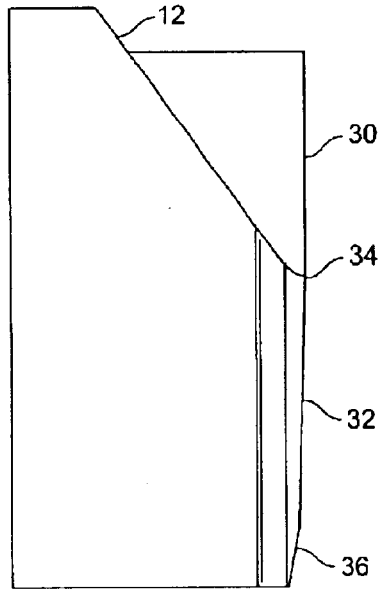
FIG. 1C is a side view of the sliding block of FIG. 1B.

FIG. 1C is a side view of the sliding block 12 of FIG. 1B. The vertical portion 30 is separated from the angled portion 32 by the break line 34. The taper of the angled portion 32 and the lead-in 36 are exaggerated for purposes of illustration. Alternatively, a mortise is formed in the sliding block and a dovetail tenon is formed on the base; however, forming the tenon on the sliding block provides a superior ground-plane contact between the sliding block 12 and the base 14 underneath the aperture 22.

Figure 1D:
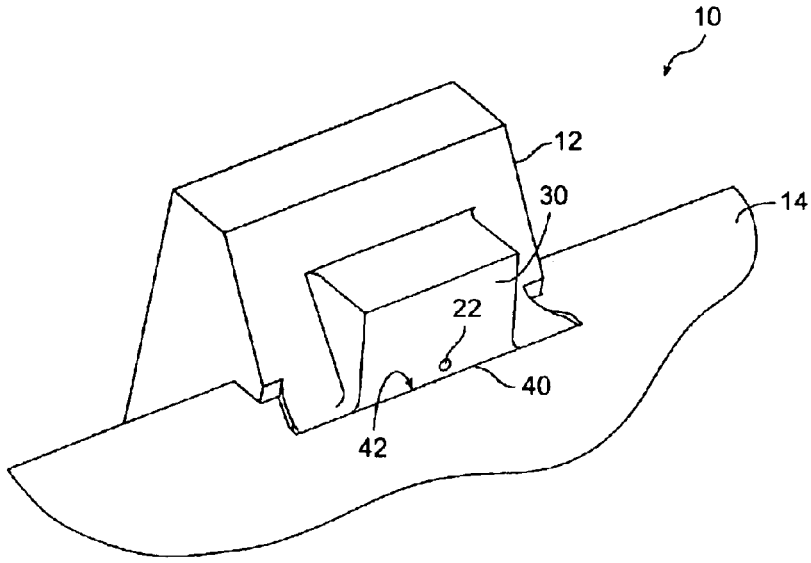
FIG. 1D is a close-up perspective view of a ground plane contact of the adjustable coaxial support of FIG. 1A.

FIG. 1D is a close-up perspective view of a ground plane contact 40 of the adjustable coaxial support 10 of FIG. 1A. It was discovered that a good ground plane contact 40, particularly underneath the conductor of a planar microcircuit (see FIG. 1A, ref. nums. 26, 18) is important to achieve good high-frequency electrical performance. A good ground plane contact 40 is achieved by designing the vertical portion 30 of the face of the sliding block 12 so that it has an interference fit with the corresponding portion 42 of the base 14. In a particular embodiment, there is about 0.01 mm (0.0005 inches) interference between the vertical portion 30 of the face of the sliding block 12 and corresponding portion 42 of the base 14. This slight interference maintains a tight ground plane contact 40 between the base 14 and the sliding block 12 when the height of aperture 22 is adjusted for the intended planar microcircuit (not shown). In some cases the angled portion (see FIG. 1B, ref. num 32) forms an interference fit with the base 14 when the sliding block 12 is adjusted to the desired height to form a high-quality ground plane contact between the sliding block 12 and the base 14.

Figure 2A:
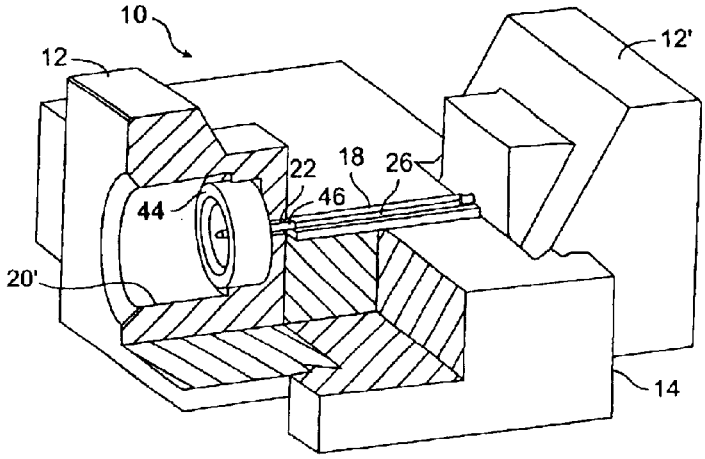
FIG. 2A is a partial cut-away perspective view of a planar microcircuit mounted on the adjustable coaxial support of FIG. 1A.

FIG. 2A is a partial cut-away perspective view of a planar microcircuit 18 mounted on the adjustable coaxial support 10 of FIG. 1A. A coaxial feed-through 44 has been mounted in the socket 20' of the sliding block 12. A center pin 46 of the coaxial feed-through 44 extends through the aperture 22. The height of the sliding block 12 has been adjusted so that the center pin 46 is the optimum height above the conductor 26 of the planar microcircuit 18 for high-frequency performance. The optimum height can be determined using a simulator, such as a HIGH FREQUENCY STRUCTURE SIMULATOR ("HFSS") available from AGILENT TECHNOLOGIES, INC. or empirically determined, and can be set using optical or mechanical techniques.

The height of the center pin 46 above the planar microcircuit 18 affects electrical performance. If the center pin 46 is too high, it might act like an antenna and radiate electrical signals. If the center pin 46 is too low, the structure might stimulate resonate modes that affect transmission of electrical signals between the center pin 46 and the conductor 26, or electrical signals might not suitably launch from the coaxial transmission structure to the planar transmission structure and vice versa. The adjustable coaxial support 10 allows the height of the center pin 46 to be adjusted for optimal electrical performance, and is intended for use at frequencies up to 110 GHz, and in some applications at frequencies up to 200 GHz. The height can be adjusted for variations in the thickness of the planar microcircuit 18 or variations in the thickness of the solder or conductive epoxy that is typically used to attach the planar microcircuit 18 to the base 14. With conventional cavity-type microcircuit packages, the height of a coaxial feed-through is fixed relative to the planar microcircuit and cannot be adjusted to account for manufacturing variations.

In some embodiments, an adjustable coaxial support is used with planar microcircuits built on substrates with different thicknesses. Referring again to FIG. 1B, in a particular embodiment the break line 34 was 0.19 mm (0.0075 inches) below the center of the aperture 22 for use with a 2.4 mm package feed-through installed in the socket of the sliding block 12. Locating the break line 34 this distance from the center of the microcircuits built on 0.125 mm (0.005 inch) substrates or 0.254 mm (0.010 inch) substrates. The face 28 of the sliding block 12 formed a high-quality ground contact with the base when used with circuits of either thickness. When used with a planar microcircuit built on a 0.125 mm substrate, the vertical portion 30 of the face 28 engaged the base, resulting in an interference fit of about 0.01 mm. It is believed that this degree of interference is not required and that engaging the tapered portion 32 of the face 28 with the base also provides a high-quality ground contact if there is sufficient interference between the face 28 of the sliding block 12 and the base. In a particular embodiment, the face forms a first aperture 22 resulted in a sliding block 12 that could be used with planar interference fit with the base at a first height, and forms a second interference fit with the base when the sliding block is adjusted to a second height wherein a difference between the first height and the second height is at least 0.125 mm.

The slight angle of the tapered portion 32 in combination with the selection of the location of the break line 34 allows the sliding block 12 to be adjusted to the desired height with minimal effort. The interference fit between the sliding block 12 and the base 14 provides a high-quality ground contact and holds the sliding block 12 in position.

One advantage of the adjustable coaxial support 10 is that the base 14 is relatively easy and inexpensive to machine, and the more complex sliding block 12 can be used with a variety of bases. A sliding block 12 may be fabricated for use with planar microcircuits 18 having thicknesses within a particular range, and used over and over again with various bases, even if the center pin 46 is soldered or otherwise attached to the planar microcircuit 18. The center pin 46 can be de-attached, and a new coaxial feed-through 44 or coaxial connector can be installed in the sliding block 12, if necessary.

For example, if the design of a planar microcircuit is changed to make the planar microcircuit 18 longer or shorter, it is not necessary to fabricate a new sliding block, only a new base of the desired length. Similarly, a sliding block may be used to test a first planar microcircuit on a first base, and re-used to test a second planar microcircuit on a second base. The adaptability of adjustable coaxial supports enables testing planar microcircuits without the need to fabricate complex, and generally unique, cavity-type microcircuit packaging. This can significantly reduce the time, expense, and effort required to design and test a planar microcircuit.

Some planar microcircuits, such as thick-film microcircuits, printed circuit board microcircuits, or locally sealed planar microcircuits, do not require hermetic packaging. A locally sealed planar microcircuit is a planar microcircuit that has a conformal protective coating over environmentally sensitive portions of the planar microcircuit, with uncoated areas for making electrical contact to the planar microcircuit. Adjustable coaxial supports according to embodiments of the present invention can be used in production applications with planar microcircuits that do not require hermetic packaging.

Figure 2B:
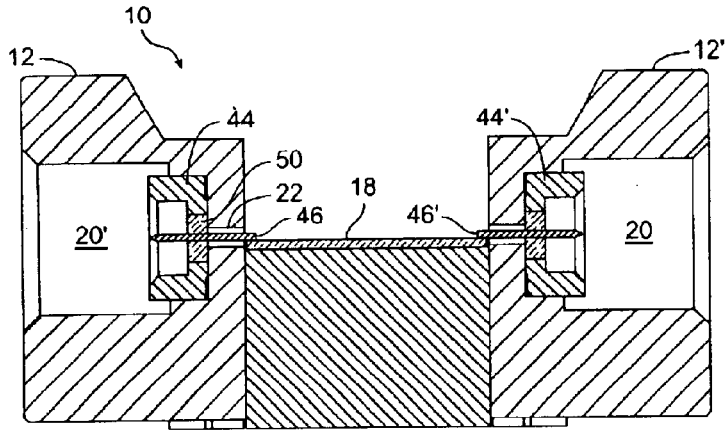
FIG. 2B is a cross-section of the planar microcircuit and adjustable coaxial support shown in FIG. 2A.

FIG. 2B is a cross section of the planar microcircuit 18 and adjustable coaxial support 10 shown in FIG. 2A. The sliding blocks 12, 12' have been adjusted in height so the center pins 46, 46' of the coaxial feed-throughs 44, 44' are at the desired height above or in contact with the planar microcircuit 18. Coaxial connectors, such as female barrels (not shown), are inserted into the sockets 20, 20' to mate with the coaxial feed-throughs 44, 44'. The coaxial feed-through 44 provides highly controlled diameters of the coaxial structure and includes glass dielectric 50, which provides secure, stable support of the center pin 46 for operation up to 110 GHz. The coaxial feed-through 44 is press-fit or soldered into the socket 20'.

Alternatively, the feed-through 44 is omitted and the socket is tapped to receive a threaded coaxial connector (not shown) having a center pin that extends through the aperture 22, or the socket 20 is tapped to receive a threaded barrel (not shown) that mates with the feed-through 44. In another embodiment, a coaxial cable is soldered or otherwise fixed in the socket 20, and a center conductor of the coaxial cable extends through the aperture 22 to be electrically coupled to the planar microcircuit 18. The socket 20 may be configured to receive a standard coaxial connector, such as a coaxial connector according to an SMA™, 2.4 mm, 1.85 mm, or 1.0 mm connector standard, or configured for a non-standard coaxial connector or feed-through. Generally, the inner diameter of the aperture 22 is selected according to the outer diameter of the center pin 46 (or center conductor of a coaxial cable) to maintain a characteristic impedance.

Figure 2C:
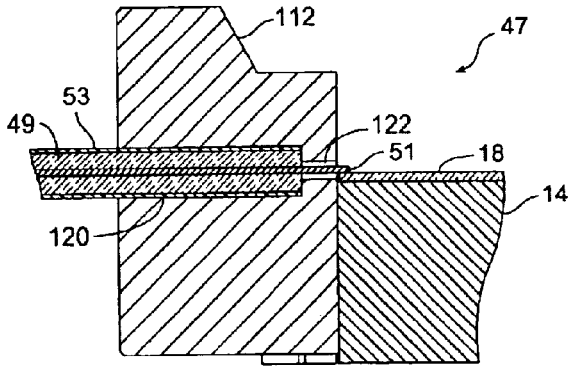
FIG. 2C is a simplified cross section of an adjustable coaxial support with a coaxial cable according to another embodiment of the present invention.

FIG. 2C is a simplified cross section of an adjustable coaxial support 47 with a coaxial cable 49 according to another embodiment of the present invention. The coaxial cable 49, such as a semi-rigid coaxial cable, includes a center conductor 51 that extends through an aperture 122 of a sliding block 112. An outer conductor 53 of the coaxial cable 49 is pressed, soldered, or otherwise electrically and mechanically coupled to a socket 120 of the sliding block 112. The center conductor 51 extends over and is electrically coupled to a planar microcircuit 18 mounted on the base 14. The coaxial cable is flexible enough to permit slight adjustment of the height of the sliding block 112, and hence center conductor 51, relative to the planar microcircuit 18.

Alternatively, the outer conductor and dielectric of the coaxial cable are flush with the face of the sliding block 112, with the center conductor 51 extending over the planar microcircuit 18. In an alternative embodiment, the center conductor and dielectric of the coaxial cable extend past the face of the sliding block 112 and the center conductor 51 further extends over the planar microcircuit. The coaxial cable can extend past the face of the sliding block if the planar microcircuit is thicker than the radius of the coaxial cable, or is placed on a pedestal or shim, for example. In embodiments where a coaxial cable extends to or beyond the face of the sliding block, the socket extends to serve as the aperture. While such embodiments are relatively easy to fabricate, the dielectric material used in semi-rigid coaxial cables is somewhat compliant (compared to the glass dielectric 50 used in the feed-through 44 shown in FIG. 2B). Stress on the center conductor can distort the coaxial relationship at the end of the cable, degrading its transmission characteristics. This degradation limits the highest frequency of operation of some embodiments where the center conductor extends directly from conventional semi-rigid coaxial cable to about 30–40 GHz.

Figure 3:
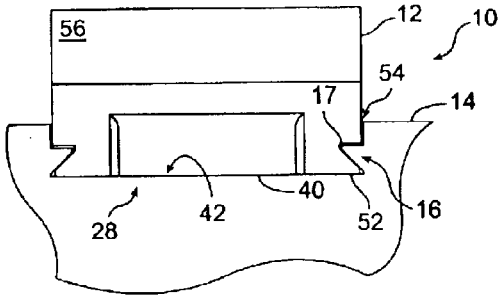
FIG. 3 is a top view of a dovetail joint of an adjustable coaxial support according to an embodiment of the present invention.

FIG. 3 is a top view of a portion of an adjustable coaxial support 10 with a dovetail joint 16 according to an embodiment of the present invention. The sliding block includes a dovetail tenon 17 that mates with a mortise 52 formed in the base 14. When the face 28 of the sliding block 12 interferes with the corresponding portion 42 of the base 14, the mortise 52 and dovetail tenon 17 flex slightly to accommodate the interference without distorting the ground plane contact 40 between the base 14 and the sliding block 12.

An optional channel 54 about 1.0 mm deep with about 0.005 mm clearance between the sliding block 12 and the base 14 reduces twisting of the sliding block 12 relative to the base 14 when a cable or connector is attached to, or removed from, the adjustable coaxial support 10. Cables and connectors are typically screwed on, and attaching and removing them produces torque that might otherwise twist the sliding block 12 and alter the electrical performance of the adjustable coaxial support 10. The channel 54 in combination with the dovetail joint 16 provides vertical adjustability of the sliding block 12 while avoiding twisting of the sliding block due to applied torque.

An adjustable coaxial support was fabricated according to FIG. 3 and the sliding block 12 was inserted into the base 14 until the face 28 interfered with the corresponding portion 42 of the base 14. An indicator was placed on an outer corner 56 of the sliding block 12 and a maximum torque of 25 in-lbs was applied about the center line of the socket (see FIG. 2B, ref. num. 20). The indicator deflection was only 0.010 mm (0.0004 inches). Such low deflection is not necessary for all embodiments of the present invention.

III. An Exemplary Locking Mechanism

Figure 4A:
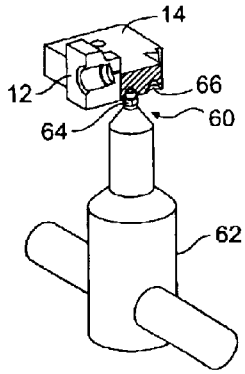
FIG. 4A is a perspective partial cut-away view of an optional locking mechanism for use with an adjustable coaxial support according to an embodiment of the present invention.

FIG. 4A is a perspective partial cutaway view of an optional locking mechanism 60 for use with an adjustable coaxial support according to an embodiment of the present invention. A tool 62 having a head 64 is inserted into a slot 66 in the base 14. The edge of the slot 66 proximate to the sliding block 12 is about 0.5 mm from the tapered portion of the face of the sliding block. After the sliding block 12 is pressed into position relative to the base 14, the tool 62 is inserted into the slot 66. The head 64 of the tool 62 has a slip-fit in one orientation and an interference fit when rotated ninety degrees. Inserting the head 64 in the slot 66 and rotating the tool 62 one-hundred and eighty degrees displaces material from the base 14 into the face of the sliding block 12. The tool 62 is then removed from the base 14.

Figure 4B:
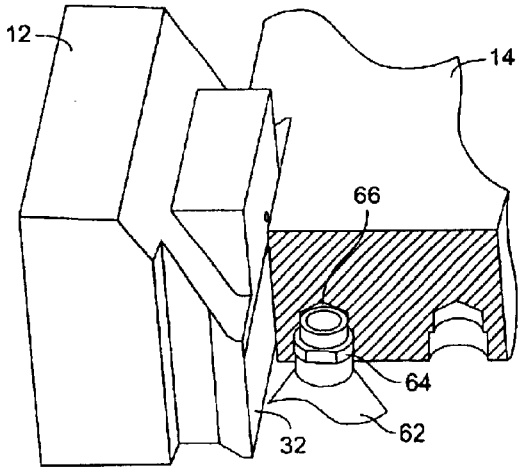
FIG. 4B is a close-up of a portion of the locking mechanism of FIG. 4A.

FIG. 4B is a close-up of a portion of the locking mechanism 60 of FIG. 4A. The head 64 of the tool 62 is inserted into the slot 66. Rotating the tool 62 displaces material from the base 14 into the tapered portion 32 of the face of the sliding block 12. Alternatively, the sliding block 12 is secured to the base 14 with adhesive or solder after adjusting the height of the sliding block 12.

While the preferred embodiments of the present invention have been illustrated in detail, it should be apparent that modifications and adaptations to these embodiments might occur to one skilled in the art without departing from the scope of the present invention as set forth in the following claims.

What is claimed is:

1. An adjustable coaxial support for a planar microcircuit, the adjustable coaxial support comprising:

a base; and a block slidably coupled to the base, the block having a socket configured to accept a coaxial structure, an aperture, and a face proximate to the base, the aperture extending from the socket to the face wherein the face forms an interference fit with the base when the sliding block is positioned with the aperture at a selected height relative to the planar microcircuit.

2. The adjustable coaxial support of claim 1 wherein the coaxial structure includes a center conductor and the selected height of the aperture is established according to a position of the center conductor relative to the planar microcircuit.

3. The adjustable coaxial support of claim 1 wherein at least one of the base and the block is plated with soft gold to facilitate a ground plane contact between the base and the block.

4. The adjustable coaxial support of claim 3 wherein the base is plated with soft gold and the block is plated with soft gold.

5. The adjustable coaxial support of claim 1 wherein the block is slidably coupled to the base with a dovetail joint having a mortise and a tenon.

6. The adjustable coaxial support of claim 5 wherein at least one of the mortise and the tenon flexes to accommodate the interference fit.

7. The adjustable coaxial support of claim 5 further comprising a channel to reduce twisting of the block relative to the base when torque is applied to the block.

8. The adjustable coaxial support of claim 1 wherein the face includes a vertical portion and an angled portion.

9. The adjustable coaxial support of claim 8 wherein the vertical portion forms a first interference fit at a first height of the aperture from the base and the angled portion forms a second interference fit at a second height of the aperture from the base.

10. The adjustable coaxial support of claim 8 wherein the interference fit arises between the angled portion and the base when the block is adjusted so that the aperture is at the selected height.

11. The adjustable coaxial support of claim 1 wherein the socket is configured to accept a coaxial feed-through.

12. The adjustable coaxial support of claim 11 wherein the socket is threaded.

13. The adjustable coaxial support of claim 1 wherein the socket is configured to accept a coaxial cable.

14. The adjustable coaxial support of claim 1 wherein the face forms a second interference fit with the base when the sliding block is adjusted to a second height, a difference between the selected height and the second height being at least 0.125 mm.

15. The adjustable coaxial support of claim 1 wherein the base comprises copper alloy.

16. The adjustable coaxial support of claim 15 wherein the copper alloy is selected from the group consisting of beryllium-copper alloy, tellurium-copper alloy, and tungsten-copper alloy.

17. An adjustable coaxial support for a planar microcircuit mounted, the adjustable coaxial support comprising:

a base; and a block slidably coupled to the base with a dovetail joint, the block having a socket configured to accept a coaxial structure, an aperture, and a face proximate to the planar microcircuit, the face having a vertical portion and an angled portion, the aperture extending from the socket to the vertical portion of the face wherein the face forms a first interference fit with the base when the block is adjusted so that the aperture is at a first height relative to the planar microcircuit and the face forms a second interference fit with the base when the block is adjusted so that the center conductor is at a second height relative to the planar microcircuit.

18. The adjustable coaxial support of claim 17 wherein the socket is configured to accept a coaxial feed-through.

19. The adjustable coaxial support of claim 17 wherein the socket is configured to accept a coaxial cable.

20. The adjustable coaxial support of claim 17 wherein the first interference fit is between the base and the vertical portion and the second interference fit is between the base and the angled portion.

* * * * *